US010467844B2

(12) United States Patent
Diaz

(10) Patent No.: US 10,467,844 B2
(45) Date of Patent: Nov. 5, 2019

(54) VENDING MACHINES HAVING A TRANSPARENT DISPLAY

(71) Applicant: Manufacturing Resources International, Inc., Alpharetta, GA (US)

(72) Inventor: Marcos Diaz, Alpharetta, GA (US)

(73) Assignee: Manufacturing Resources International, Inc., Alpharetta, GA (US)

( * ) Notice: Subject to any disclaimer, the term of this patent is extended or adjusted under 35 U.S.C. 154(b) by 0 days.

(21) Appl. No.: 15/448,178

(22) Filed: Mar. 2, 2017

(65) Prior Publication Data

US 2017/0256115 A1 Sep. 7, 2017

Related U.S. Application Data

(60) Provisional application No. 62/302,228, filed on Mar. 2, 2016.

(51) Int. Cl.

| | |
|---|---|
| ***G07F 9/02*** | (2006.01) |
| ***G07F 9/10*** | (2006.01) |
| ***G09G 3/3208*** | (2016.01) |
| ***G07F 11/00*** | (2006.01) |

(52) U.S. Cl.

CPC ..... *G07F 9/023* (2013.01); *G07F 9/10* (2013.01); *G07F 11/00* (2013.01); *G09G 3/3208* (2013.01); *G09G 2300/04* (2013.01)

(58) Field of Classification Search

CPC ..... G07F 11/10; G07F 9/00; G07F 27/00
See application file for complete search history.

(56) References Cited

U.S. PATENT DOCUMENTS

| | | | |
|---|---|---|---|
| 3,629,972 | A | 12/1971 | Rehberg et al. |
| 4,040,726 | A | 8/1977 | Paca |
| 4,299,092 | A | 11/1981 | Ibrahim |
| 4,371,870 | A | 2/1983 | Biferno |

(Continued)

FOREIGN PATENT DOCUMENTS

| | | | |
|---|---|---|---|
| CA | 2815355 | A1 | 5/2012 |
| CN | 101949526 | A | 1/2011 |

(Continued)

OTHER PUBLICATIONS

A. Vogler & H. Kunkley, Photochemistry and Beer, Jan. 1982, 3 Pages, vol. 59, No. 1.

(Continued)

*Primary Examiner* — Gene O Crawford
*Assistant Examiner* — Kelvin L Randall, Jr.
(74) *Attorney, Agent, or Firm* — Standley Law Group LLP; Jeffrey S. Standley; Adam J. Smith

(57) ABSTRACT

A vending machine with a transparent electronic display includes a pair of lighting strips for illuminating a storage compartment which holds retails goods. A door frame assembly covers the front of the storage compartment. A cover glass is placed in front of and spaced apart from the transparent electronic display. A series of brackets connect the cover glass and the transparent electronic display to a door frame assembly and cover the gap between the cover glass and the transparent electronic display, masking the region located beyond the brackets.

16 Claims, 15 Drawing Sheets

(56) References Cited

U.S. PATENT DOCUMENTS 4,853,678 A 8/1989 Bishop, Jr. et al.
7,413,233 B1 8/2008 Jung
7,513,637 B2 * 4/2009 Kelly ..... A47F 3/001 362/125
7,922,381 B2 4/2011 Han et al.
8,254,121 B2 8/2012 Lee et al.
8,417,376 B1 * 4/2013 Smolen ..... G07F 11/002 221/155
8,578,081 B1 11/2013 Fils
8,683,745 B2 4/2014 Artwohl et al.
8,982,013 B2 3/2015 Sako et al.
8,988,635 B2 3/2015 Dunn et al.
9,052,536 B2 6/2015 Artwohl et al.
9,155,405 B2 10/2015 Artwohl et al.
9,500,801 B2 11/2016 Dunn
9,500,896 B2 11/2016 Dunn et al.
9,514,661 B2 12/2016 Riegel
9,519,185 B2 12/2016 Dunn et al.
9,526,352 B2 12/2016 Dunn et al.
9,535,293 B2 1/2017 Dunn
9,633,366 B2 4/2017 Dunn
9,661,939 B2 5/2017 Dunn et al.
9,684,124 B2 6/2017 Dunn
9,733,420 B2 8/2017 Dunn et al.
2002/0064037 A1 5/2002 Lee
2002/0075552 A1 6/2002 Poll et al.
2002/0187575 A1 12/2002 Maruyama et al.
2003/0117790 A1 6/2003 Lee et al.
2004/0160388 A1 8/2004 O'Keeffe
2005/0265019 A1 * 12/2005 Sommers ..... A47F 3/001 362/217.16
2006/0215958 A1 9/2006 Yeo et al.
2006/0284788 A1 12/2006 Robinson et al.
2007/0151274 A1 7/2007 Roche et al.
2007/0171647 A1 7/2007 Artwohl et al.
2007/0195535 A1 * 8/2007 Artwohl ..... A47F 3/001 362/341
2007/0214812 A1 9/2007 Wagner et al.
2008/0024047 A1 1/2008 Juo et al.
2008/0055534 A1 3/2008 Kawano
2008/0094854 A1 4/2008 Coleman et al.
2008/0284942 A1 11/2008 Mahama et al.
2008/0295033 A1 11/2008 Lee et al.
2009/0002990 A1 1/2009 Becker et al.
2009/0015400 A1 1/2009 Breed
2009/0097227 A1 4/2009 Kim et al.
2009/0121970 A1 5/2009 Ozbek
2009/0278766 A1 11/2009 Sako et al.
2009/0300953 A1 12/2009 Frisch et al.
2010/0026912 A1 2/2010 Ho
2010/0162747 A1 7/2010 Hamel et al.
2010/0238394 A1 9/2010 Dunn
2010/0293827 A1 11/2010 Suss et al.
2010/0309687 A1 12/2010 Sampsell et al.
2011/0083460 A1 4/2011 Thomas et al.
2011/0116000 A1 5/2011 Dunn et al.
2011/0116231 A1 5/2011 Dunn et al.
2012/0020560 A1 1/2012 Zarubinsky
2012/0105424 A1 5/2012 Lee et al.
2012/0105428 A1 5/2012 Fleck et al.
2012/0206500 A1 8/2012 Koprowski et al.
2012/0206941 A1 8/2012 He
2012/0275477 A1 11/2012 Berendt et al.
2012/0287368 A1 11/2012 Que et al.
2013/0016296 A1 1/2013 Fujita et al.
2013/0063326 A1 3/2013 Riegel
2013/0120815 A1 5/2013 Aspnes et al.
2013/0151006 A1 6/2013 Garson et al.
2013/0158703 A1 6/2013 Lin et al.
2013/0208447 A1 * 8/2013 Maslen ..... A47F 3/0426 362/94
2013/0211583 A1 * 8/2013 Borra ..... G07F 9/02 700/232
2013/0265525 A1 10/2013 Dunn et al.
2013/0271696 A1 10/2013 Dunn
2014/0062316 A1 3/2014 Tischler et al.
2014/0078407 A1 * 3/2014 Green ..... G09F 9/35 348/836
2014/0085564 A1 3/2014 Hendren et al.
2014/0104538 A1 4/2014 Park et al.
2014/0137065 A1 5/2014 Feng et al.
2014/0144083 A1 * 5/2014 Artwohl ..... A47F 3/0434 49/70
2014/0204452 A1 7/2014 Branson
2014/0285732 A1 9/2014 Tanabe et al.
2014/0333541 A1 11/2014 Lee et al.
2015/0035432 A1 2/2015 Kendall et al.
2015/0177480 A1 6/2015 Bullock et al.
2015/0250021 A1 9/2015 Stice et al.
2015/0253612 A1 9/2015 Hasegawa et al.
2015/0300628 A1 10/2015 Dunn et al.
2015/0309263 A2 10/2015 Abovitz et al.
2015/0338715 A1 11/2015 Schaefer et al.
2015/0362667 A1 12/2015 Dunn
2015/0362768 A1 12/2015 Dunn
2015/0362792 A1 * 12/2015 Dunn ..... A47F 3/043 349/65
2015/0363819 A1 12/2015 Dunn
2015/0366083 A1 12/2015 Dunn et al.
2016/0037657 A1 2/2016 Yoshizumi
2016/0061514 A1 3/2016 Seo et al.
2016/0091755 A1 3/2016 Dunn
2016/0095450 A1 * 4/2016 Trulaske, Sr. ..... A47F 11/10 312/116
2016/0103275 A1 4/2016 Diaz et al.
2016/0106231 A1 4/2016 Dunn et al.
2016/0192451 A1 6/2016 Dunn et al.
2017/0046991 A1 2/2017 Riegel
2017/0068042 A1 3/2017 Dunn et al.
2017/0068044 A1 3/2017 Dunn
2017/0099960 A1 4/2017 Dunn et al.
2017/0108735 A1 4/2017 Dunn
2017/0228770 A1 8/2017 Dunn
2017/0256115 A1 9/2017 Diaz

FOREIGN PATENT DOCUMENTS

CN 202815379 U 3/2013
EP 3155607 A1 4/2017
JP 2010171010 A 8/2010
KR 1020040045939 A 6/2004
WO WO2006055873 A2 5/2006
WO WO2010116202 A1 10/2010
WO WO2013056109 A1 4/2013
WO WO2015195681 A1 12/2015
WO WO2017151934 A1 9/2017

OTHER PUBLICATIONS

Dave Ross, How Transmissive Film Works, 2008, 9 Pages.
Pilkington TEC Glass, for the Refrigeration Market, 2002, 2 Pages.

* cited by examiner

VENDING MACHINES HAVING A TRANSPARENT DISPLAY

CROSS-REFERENCE TO RELATED APPLICATIONS

This application claims the benefit of U.S. Provisional Patent Application No. 62/302,228 filed Mar. 2, 2016, the disclosures of which are hereby incorporated by reference.

TECHNICAL FIELD

Embodiments of the present invention generally relate to vending machines having electronic displays.

BACKGROUND

Vending machines have long been used to sell food and drink items. Recently, vending machines have expanded to include the sales of various retail products. Vending machines are typically placed in locations of high public traffic so as to maximize exposure to potential customers. Vending machines often include a transparent customer-facing panel so that the customer may view the items stored within. These transparent panels expose the products stored within to sunlight and other ambient conditions. Alternatively, some vending machines feature a large graphic on the customer-facing panel displaying the likeness of items stored within. The graphic may be displayed on a poster or be integrated with the customer-facing panel. However, these displays provide only static images and cannot be changed without significant effort.

SUMMARY OF THE INVENTIVE CONCEPT

Exemplary embodiments may comprise a vending machine having a transparent electronic display integrated therewith. The vending machine may comprise a storage area for holding various retail items and a door frame assembly. The transparent electronic display may be integrated with the door frame assembly. The transparent electronic display may be an organic light emitting diode (OLED) type display. The electronic display may be bonded or otherwise adhered to metal brackets which are attached to the door frame assembly. The vending machine may further comprise a control device that alters the transparency level of the transparent electronic display as well as controls the content displayed thereon. The transparent display may permit the customer to view the products stored within the vending machine as well as display graphical content such as videos and images. The transparent display may also be set to various levels of opacity to control the exposure of the products stored within to sunlight and other ambient conditions.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
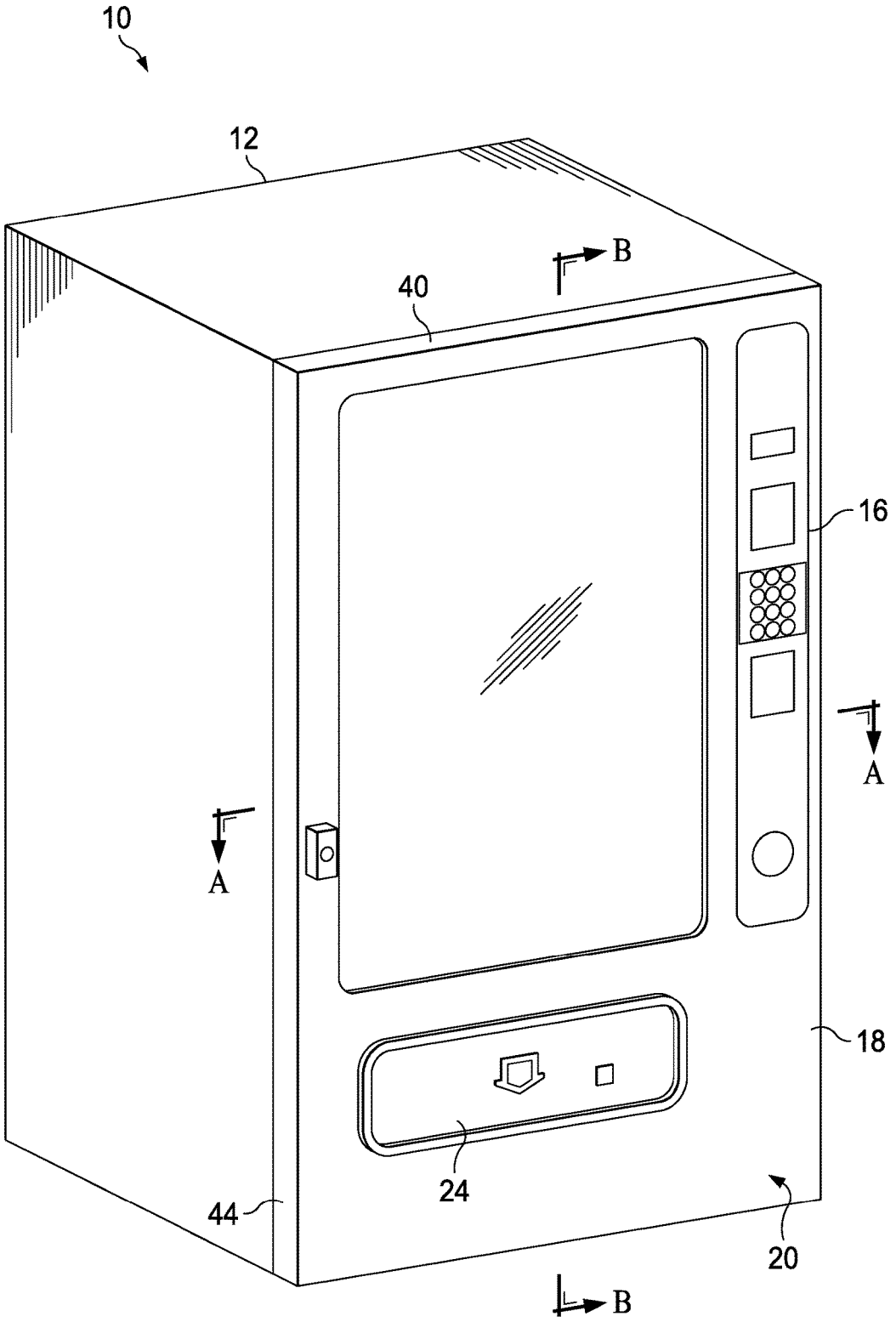
FIG. 1 is a front perspective view of an exemplary embodiment of the vending machine also indicating section line A-A and section line B-B.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 In an exemplary embodiment of the present invention, a vending machine, indicated generally at 10, comprises a storage cabinet 12 and a door assembly 20. The storage cabinet 12 and the door assembly 20 may be attached to one another in a hinged manner such that when the door assembly 20 is placed in a closed position the storage cabinet 12 is enclosed. The door assembly 20 may be placed in an opened position for maintenance and to restock the various retail items located in the storage cabinet 12.

Any size and shape storage cabinet 12 is contemplated. The door assembly 20 may be comprised of a frame 18 having a number of apertures, including an aperture for a dispensing device 24. The dispensing device 24 may include a hinged panel located atop the aperture. Alternatively, the dispensing device 24 may be an interior compartment with an aperture facing the customer such that the customer may reach in and take the item dispensed therefrom. The dispensing device 24 may fit an oval shaped aperture, though any size or shape aperture and dispensing device 24 are contemplated. The dispensing device 24 may be located towards the bottom of the door assembly 20, though any location is contemplated.

The door assembly 20 may additionally include a user interface 16. The interface 16 may be comprised of display screens, buttons, knobs, dials, key pads, and the like which are configured to permit the customer to select a particular product to be vended and provide payment, if required. The user interface 16 may provide other information such as what item has been selected, payment information, and the like. As will be described in greater detail, the frame 18 may surround the perimeter of a front panel 26 and an electronic display 28.

Figure 2:
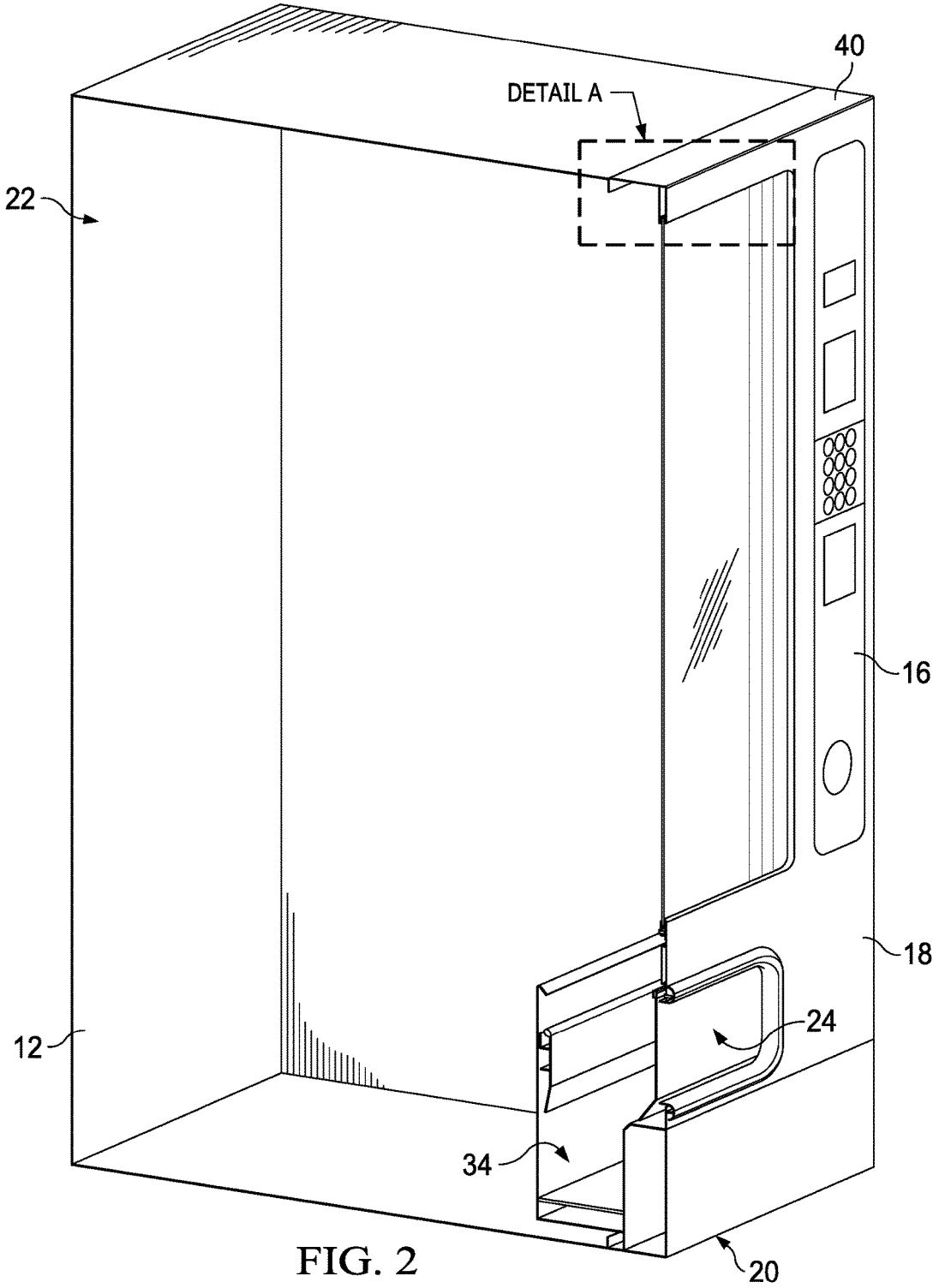
FIG. 2 is a side perspective, sectional view of the device of FIG. 1 taken along section line B-B and also indicating Detail A.

FIG. 2 The storage cabinet 12 may define a storage compartment 22 located behind the door assembly 20. The storage compartment 22 may be any shape or size and may be configured to house a variety of retail items, including but not limited to, food products, beverages, electronics, clothing, fasteners, safety equipment, and the like. The storage compartment 22 may comprise a number of shelves, racks, or the like for storing, showcasing, and selectively dispensing the retail items stored therein.

In exemplary embodiments, the dispensing device 24 may comprise a trough 34 formed between the door assembly 20 and the storage compartment 22. The door assembly 20 may include a U-shaped trough 34 formed from the rear surface of the frame 18 and a panel that extends into the storage compartment 22 and up therefrom, thereby forming a "U". The vended products may be deposited into the trough 34 and retrieved through the dispensing device 24 aperture. Any size, shape, and location of the trough 34 or other dispensing device 24 is contemplated.

Figure 3:
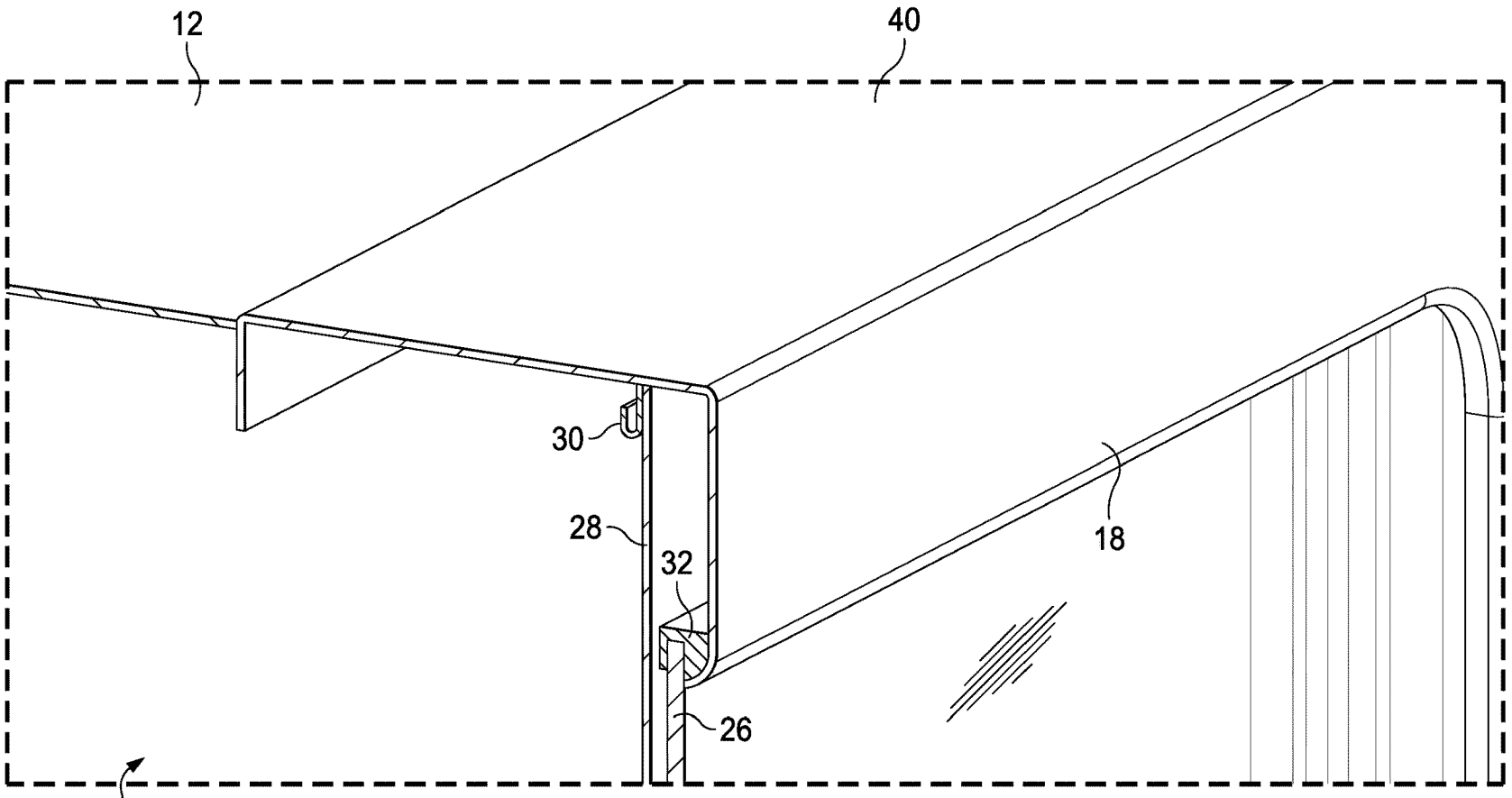
FIG. 3 is a detailed perspective view of Detail A shown in FIG. 2.

FIG. 3 The exemplary embodiments of the vending machine 10 may be comprised of the front panel 26 and the electronic display 28. The front panel 26 may be a transparent panel comprised of glass, a polymer, or the like. Preferably, the front panel 26 may be comprised of two panels of glass laminated together. The front panel 26 may be fit within a corresponding groove 32 which is bonded to or integrally formed with the frame 18 of the door assembly 20. The groove 32 may extend around various portions of the front panel 26 perimeter, but it is not necessary for the groove 32 to surround the entire perimeter of the front panel 26. In other exemplary embodiments of the present invention, the front panel 26 may be bonded or adhered directly to the frame 18. The front panel 26 may have a smaller vertical height than the electronic display 28, though any size or shape front panel 26 is contemplated.

The electronic display 28 may be located behind the front panel 26. The electronic display 28 may be a transparent electronic display. In exemplary embodiments of the present invention, the transparent electronic display may be an OLED type display, though other types of electronic displays are contemplated. The electronic display 28 may comprise a glass or polymer substrate. The electronic display 28 may be set to various levels of transparency such that the various retail items stored within the storage compartment 22 may be viewed. Additionally, the various levels of transparency, and thus opacity, may be used to control the exposure of the various retail items to sunlight and other ambient conditions. The transparency level of the electronic display 28 may be programmed by a controller 36.

The frame 18 preferably contains a substantially horizontal plate 40 positioned near the top of the frame 18. A bracket 30 preferably extends downwardly from the underside of the plate 40 and contains a flat front surface that is generally perpendicular to the plate 40. If using a OLED type electronic display 28, the substrate containing the OLED materials is preferably bonded to the flat front surface of the bracket 30. The bonding may be accomplished by an adhesive such as 3M™ VHB™ tape. Alternatively, it is contemplated that the bracket may be integrally formed with the frame 18. The bracket 30 may be comprised of a metallic, such as aluminum or the like. In exemplary embodiments of the present invention, the bracket 30 may be J-shaped, though any shape is contemplated. The curved portion of the "J" may extend inwardly towards the storage compartment 22. The electronic display 28 may be bonded to the stem of the J-shaped bracket 30. The bracket 30 may extend the length of the top edge of the electronic display 28.

In exemplary embodiments of the present invention, the upper edge of the frame 18 may be in the shape of a downward facing "C" such that the open part of the "C" faces downward, though any shape is contemplated. The front panel 26 fitted into the groove 32 may be located at and bonded to the inner surface of the outer extreme of the "C" and the electronic display 28 bonded to the bracket 30 may be located along and bonded to the mid-section of the "C", which may be the flat plate 40. In exemplary embodiments, the bracket 30 may be bonded or otherwise adhered to the frame 18 at the top of the stem of the J-shaped bracket. Additionally, the bracket 30 may be bonded to the frame 18 at each of the extreme ends of the bracket 30. The outer surface of the inner extreme of the C-shaped frame 18 may be bonded or otherwise adhered to a matching protrusion extending from the storage cabinet 12.

Figure 4:
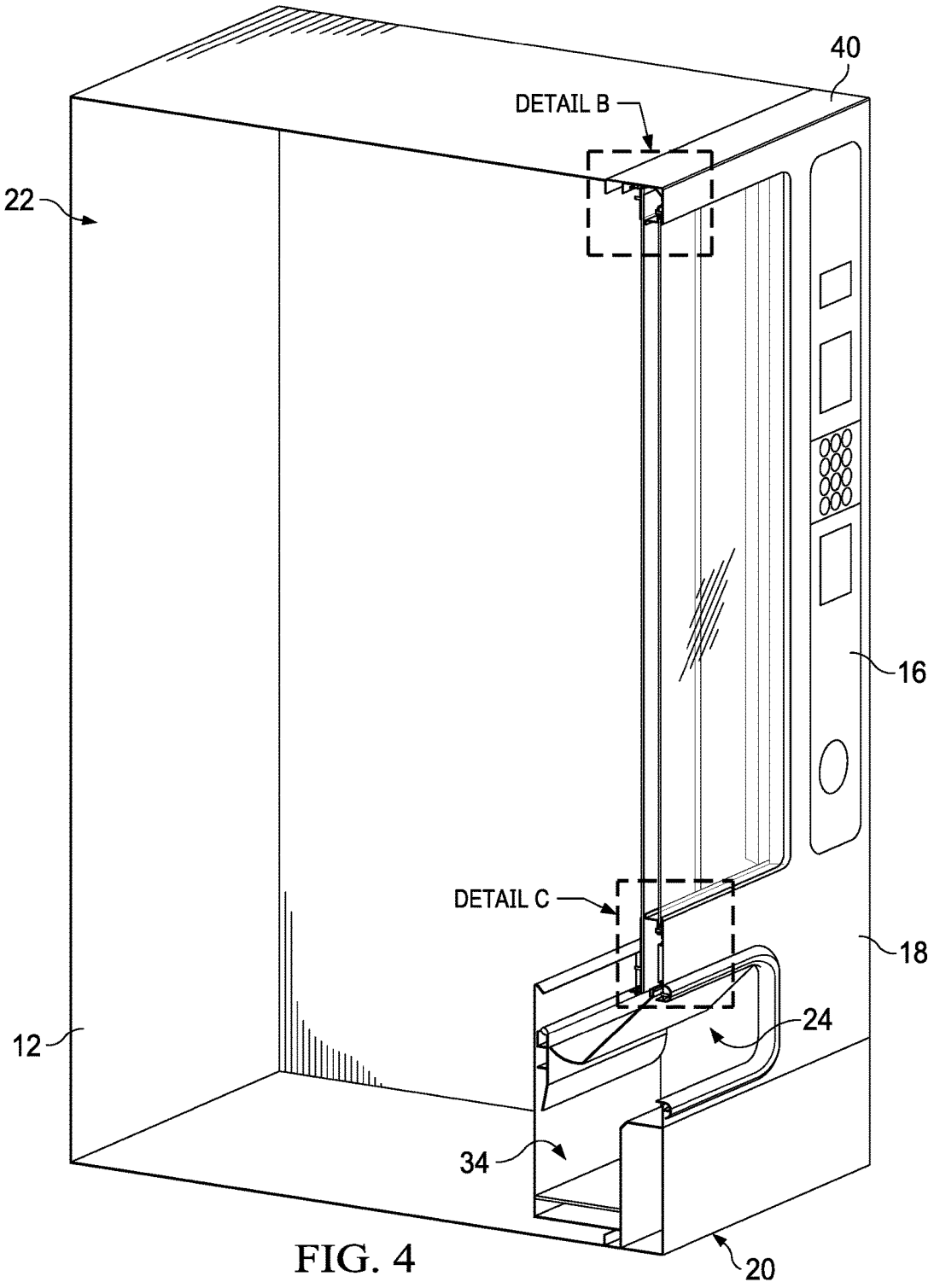
FIG. 4 is a side perspective, sectional view of another exemplary embodiment of the device of FIG. 1 taken along section line B-B and also indicating Detail B and Detail C.

FIG. 4 In other exemplary embodiments of the present invention alternative means for attaching the electronic display 28 to the frame 18 may be utilized.

Figure 5:
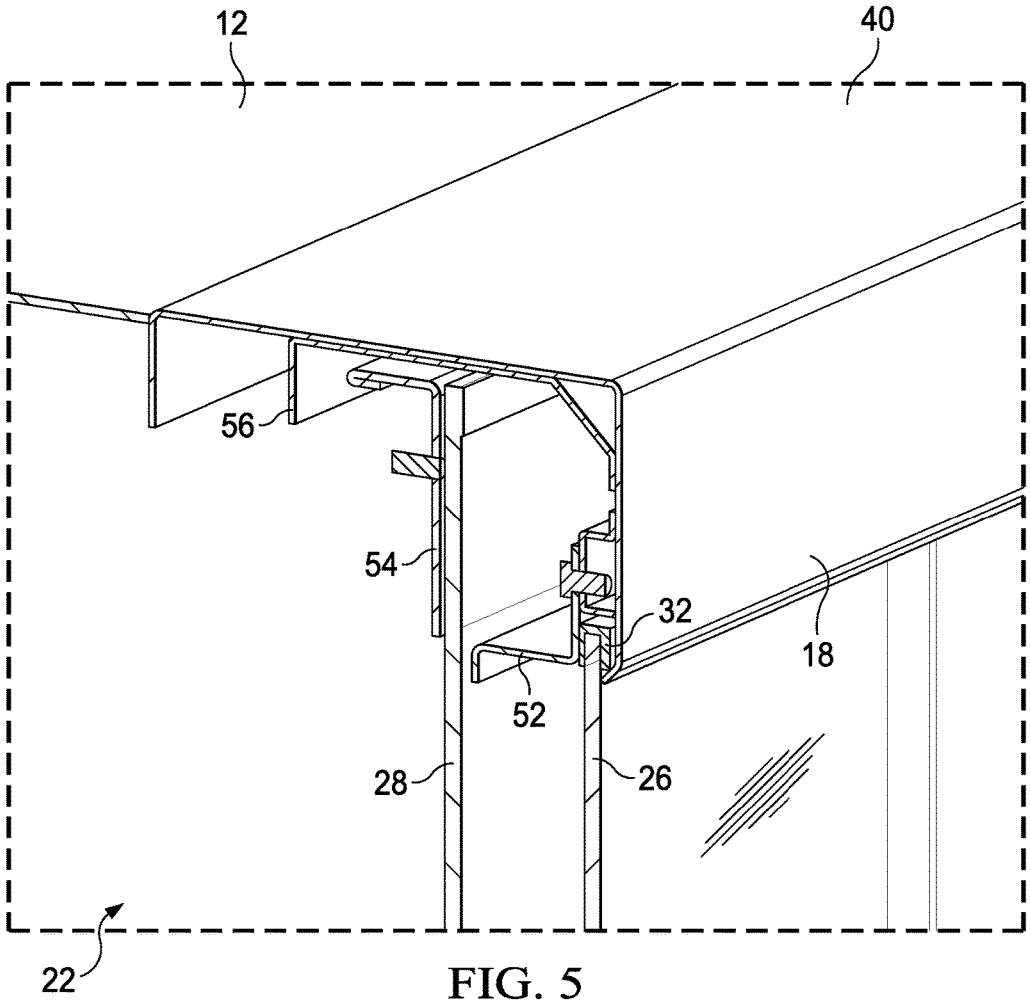
FIG. 5 is a detailed perspective view of Detail B shown in FIG. 4.

FIG. 5 In one such exemplary embodiment, the electronic display 28 may be bonded to a bracket 54. The bracket 54 may extend along the upper edge of the electronic display 28 and may comprise a flat section that extends in parallel therewith. The electronic display 28 may be bonded to this section of the bracket 54. In embodiments where the OLED type display is utilized, the substrate comprising the OLED materials may be bonded to this section of the bracket 54. In exemplary embodiments of the present invention, the electronic display 28 is bonded to the bracket 54 by use of a double sided adhesive such as 3M™ VHB™ tape. At substantially the top of the electronic display 28, the bracket 54 may be angled substantially 90 degrees such that the bracket 54 extends into the storage compartment 22. A portion of the bracket 54 which extends into the storage compartment 22 may be folded back onto itself such that it forms a J-shape.

A mask frame 52 may extend between the electronic display 28 and the front panel 26. The mask frame 52 may be configured to hide any elements in the assembly 10 located above the mask frame 52 and between the electronic display 28 and the front cover 26. A portion of the mask frame 52 may extend in parallel with the electronic display 28. In exemplary embodiments of the present invention, this portion of the mask frame 52 may be adhered to a gasket and the gasket may be adhered to the electronic display 28. In exemplary embodiments of the present invention, the gasket may be comprised of rubber, such as neoprene or the like. The mask frame 52 may then extend between and perpendicular to the electronic display 28 and the front cover 26. The mask frame 52 may extend in parallel with the front cover 26 and may be bonded to the groove 32, the frame 18, or both. In exemplary embodiments of the present invention, the mask frame 52 may be black.

A support bracket 56 may extend along and be attached to the customer facing portion of the frame 18. The support bracket 56 may then extend at an angle therefrom until intersecting the plate 40. The support bracket 56 may then extend along, and in parallel with, the inner surface of the plate 40. The end of the support bracket 56 may be angled substantially 90 degrees such that it extends into the storage compartment 22. Preferably, the support bracket 56 extends past the electronic display 28 before extending into the storage compartment 22.

Figure 6:
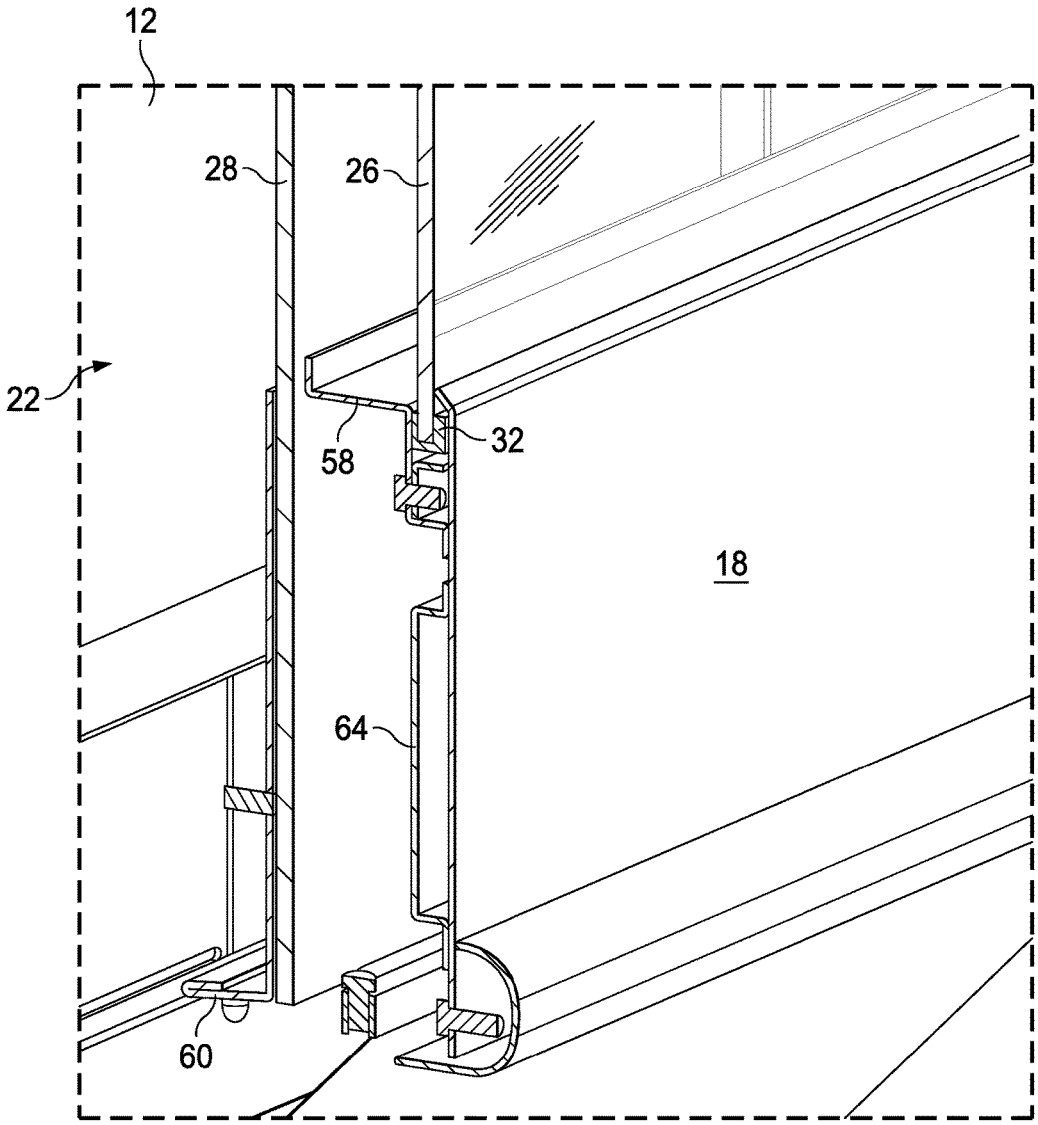
FIG. 6 is a detailed perspective view of Detail C shown in FIG. 4.

FIG. 6 Similarly, the lower end of the electronic display 28 may be bonded to a bracket 60. A portion of the bracket 60 may extend substantially parallel with and be bonded to the electronic display 28. At the lower edge of the electronic display 28 the bracket 60 may be angled substantially 90 degrees such that it extends into the storage compartment 22. A portion of the bracket 60 that extends into the storage compartment 22 may be folded over itself such that it forms a J-shape. The electronic display 28 may be bonded to the bracket 54 by use of a double sided adhesive such as 3M™ VHB™ tape.

A lower mask frame 58 similar to mask frame 52 may extend between the electronic display 28 and the front cover 26 and be configured to hide from view any elements located between the electronic display 28 and the front cover 26 and below the frame 18.

A support brace 64 may extend along an inner surface of the customer facing portion of the frame. The support brace 64 may be adhered to the frame 18 at either end. The mid-section of the support brace 64 may be spaced apart from and extend substantially in parallel with the frame 18.

Figure 7:
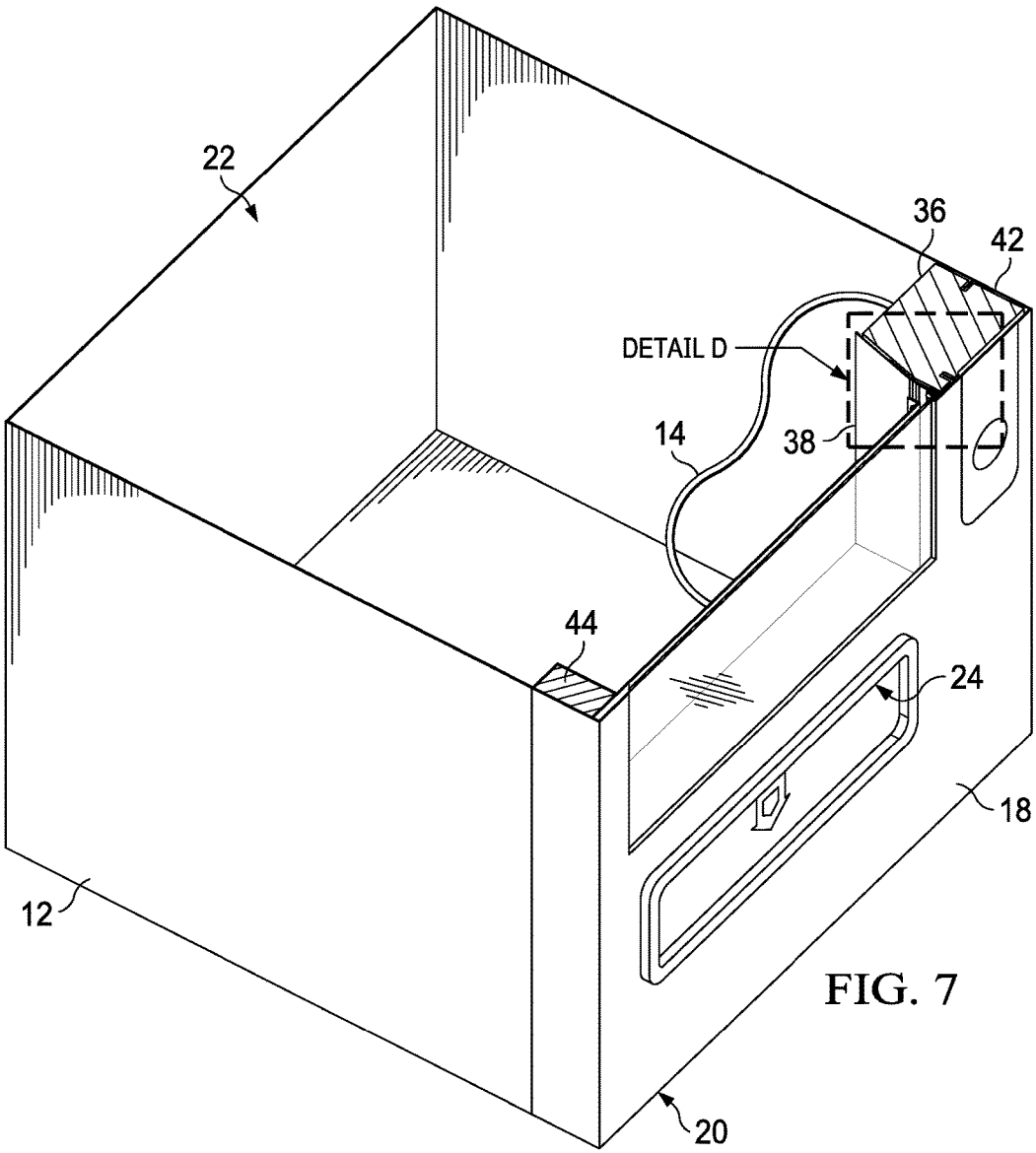
FIG. 7 is a top perspective, sectional view of the device of FIG. 1 taken along section line A-A and indicating Detail D.

FIG. 7 In exemplary embodiments of the present invention, the frame 18 may likewise be C-shaped along the right edge of the door assembly 20 when viewed from the front. The frame 18 preferably contains a substantially vertical flat plate 42 that extends perpendicularly to the customer facing portion of the frame 18. The customer facing portion of the frame 18 may form one extreme of the "C". The other extreme of the "C" may comprise a panel extending from the end of the flat plate 42 at a perpendicular angle into the storage compartment 22. The outer surface of this panel may be abutted to the outer surface of a similar panel protruding from the storage cabinet 12 and the two may be bonded together.

In exemplary embodiments of the present invention, the frame 18 may contain a column 44 along the left edge of the door assembly 20 when viewed from the front. The column 44 may form the side and part of the customer facing portion of the frame 18. A portion of the outer surface of the column 44 that faces the storage compartment 22 and extends in parallel to the customer facing portion of the frame 18 may be bonded to an abutting panel that extends from the storage cabinet 12. Alternatively, the frame 18 may be formed around a portion of the column 20 and bonded thereto.

The controller 36 may be located in the storage compartment 22 and is preferably in electrical communication with the electronic display 28 such as by a wire 14, wireless communication, or the like. The controller 36 may be configured to control the content displayed on the electronic display 28 as well as operate the user interface 16. The controller 36 may comprise various electronic components including, but not limited to, the following: a timing and control board, video player, hard drive/storage, microprocessor/CPU, wireless transmitter/receiver, and internet connectivity. In other exemplary embodiments of the present invention, the controller 36 may be located in or otherwise integrated with the electronic display 28.

Figure 8:
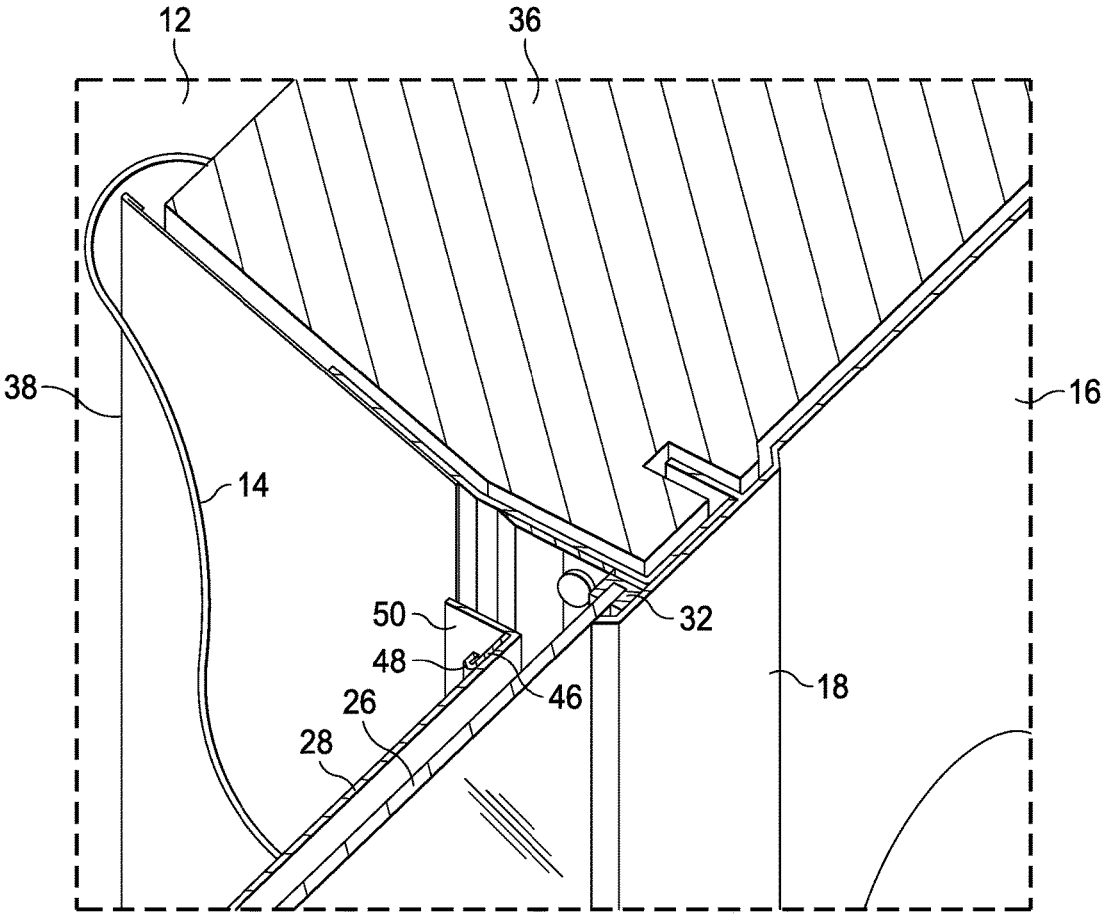
FIG. 8 is a detailed perspective view of Detail D shown in FIG. 7.

FIG. 8 The sides of the electronic display 28 may likewise be bonded to side brackets 46. In exemplary embodiments of the present invention, the side brackets 46 comprise a flat portion 50 and a J-shaped portion 48, where the stem of the J-shaped portion 48 is located at the edge of the flat portion 50 nearest the front panel 26 and where the J-shaped portion 48 extends at a perpendicular angle from the flat portion 50. The curve of the J-shaped portion 48 may extend into the storage compartment 22. If using a OLED type electronic display 28, the substrate containing the OLED materials is preferably bonded to the flat front surface of the side brackets 46, which in exemplary embodiments is the stem of the J-shaped portion 48.

The side brackets 46 may extend the length of the sides of the electronic display 28 and may be bonded to the frame 18 at the top and bottom surfaces of the side brackets 46. Similarly, the sides of the front panel 26 may be fitted into the groove 32 bonded or otherwise adhered to the frame 18. The electronic display 28 may have a smaller horizontal width than the front panel 26, though any size and shape electronic display 28 is contemplated.

A divider 38 may be located between the electronic display 28 and the user interface 16. The divider 38 may extend from the frame 18 into the storage compartment 22. In exemplary embodiments, the controller 36 is located on the right side of the divider 38 when viewed from the front. In other exemplary embodiments, the controller 36 is located on a bottom surface of the storage cabinet 12. Any location for the controller 36 is contemplated.

Figure 9:
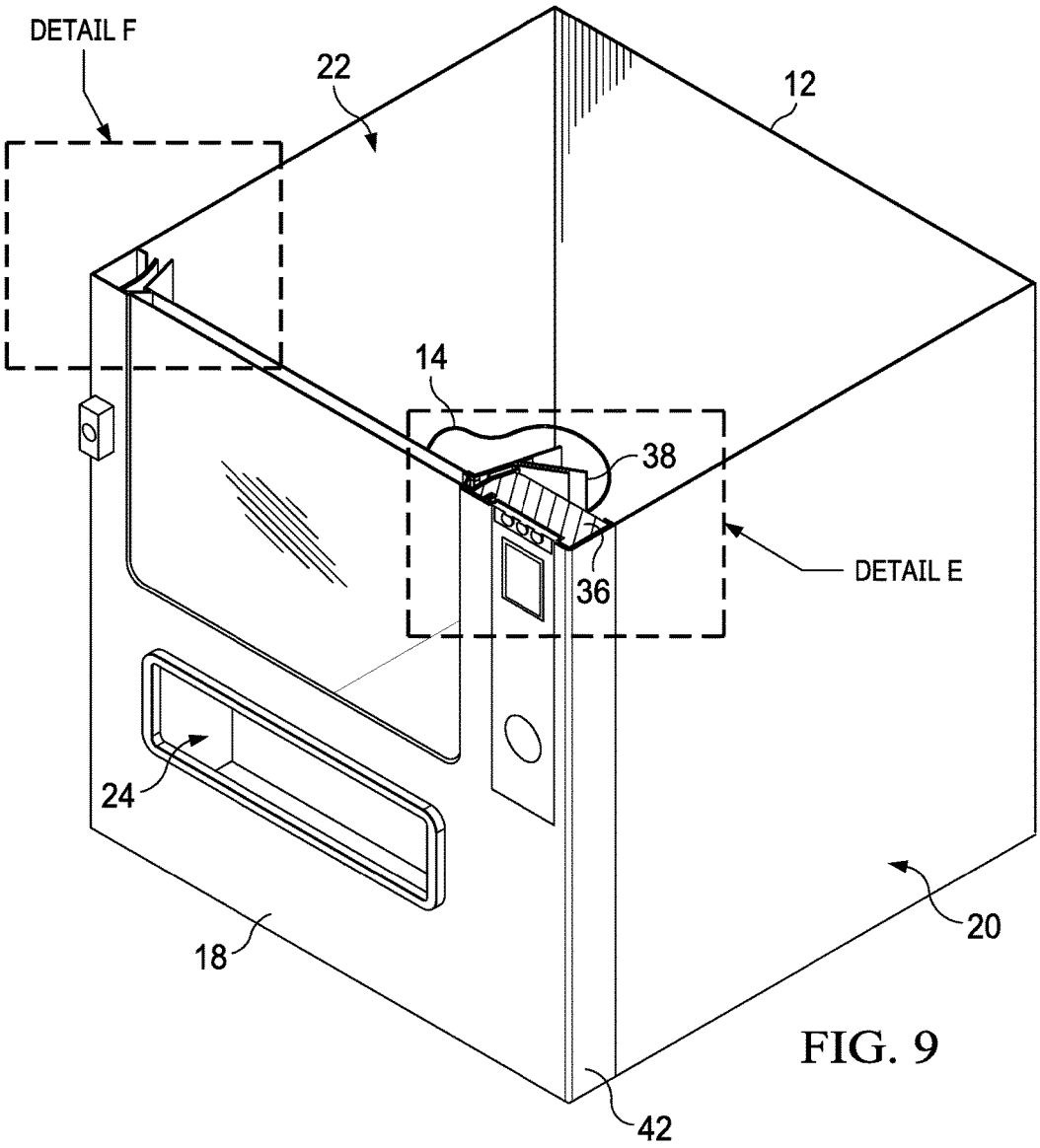
FIG. 9 is a top perspective, sectional view of another exemplary embodiment of the device of FIG. 1 taken along section line A-A and indicating Detail E and Detail F.

FIG. 9 In other exemplary embodiments of the present invention alternative means for attaching the electronic display 28 to the frame 18 may be utilized.

Figure 10:
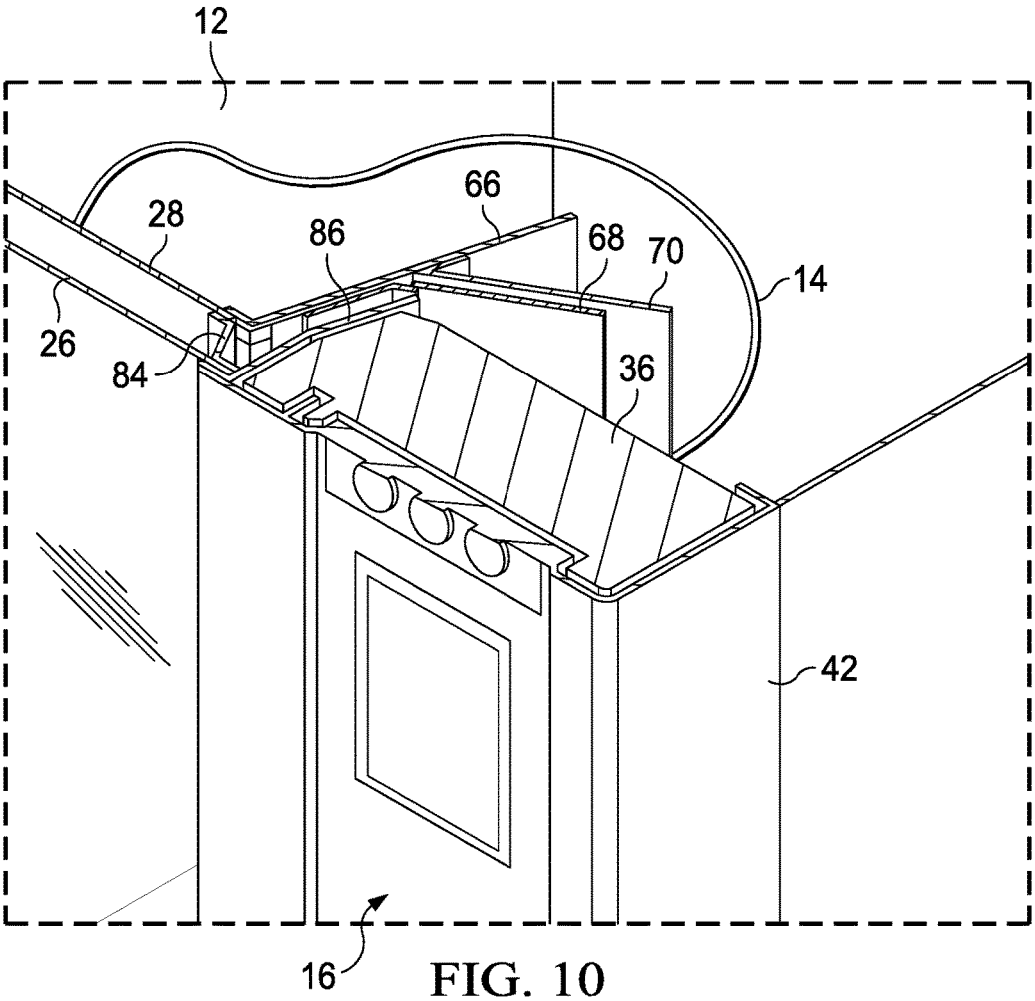
FIG. 10 is a detailed perspective view of Detail E shown in FIG. 9.

FIG. 10 In one such exemplary embodiment, a pair of side mask frames 84, similar to mask frame 52 and lower mask frame 58, may extend on either side of the door assembly 20 between the electronic display 28 and the front cover 26. In exemplary embodiments of the present invention, the side mask frames 84 may be substantially "Z" or "S" shaped such that the top surface of the Z or S is bonded to the electronic display, the mid-section of the Z or S extends between the electronic display 28 and the front cover 26, and the bottom surface of the Z or S is bonded to the front cover 26.

A pair of lighting panels 66 may extend vertically within the storage compartment 22 on either side of the electronic display 28. One of said lighting panels 66 may be located between the controller 36 and the electronic display 28 and may extend at an obtuse angle relative to the electronic display 28. The leading edge of the lighting panel 66 may be attached to the electronic display 28. The trailing edge of the lighting panel 66 may be folded over itself such that it forms a J-shape.

A support bracket 70 may also extend vertically within the storage compartment 22. The support bracket 70 may be affixed to and extend at an angle from the lighting panel 66 towards the controller 36. The trailing edge of the support bracket 70 may be folded over itself such that it forms a J-shape.

A divider 68 may be similar to divider 38 and may extend vertically within the storage compartment to separate the controller 36 and the interface 16 from the electronic display 28 and the remainder of the storage compartment 22. The divider 68 may be attached to the support bracket 70 or the lighting panel 66. A portion of the divider 68 may extend in parallel with the lighting panel 66 and a portion of the divider 68 may extend in parallel with the support bracket 70.

Figure 13:
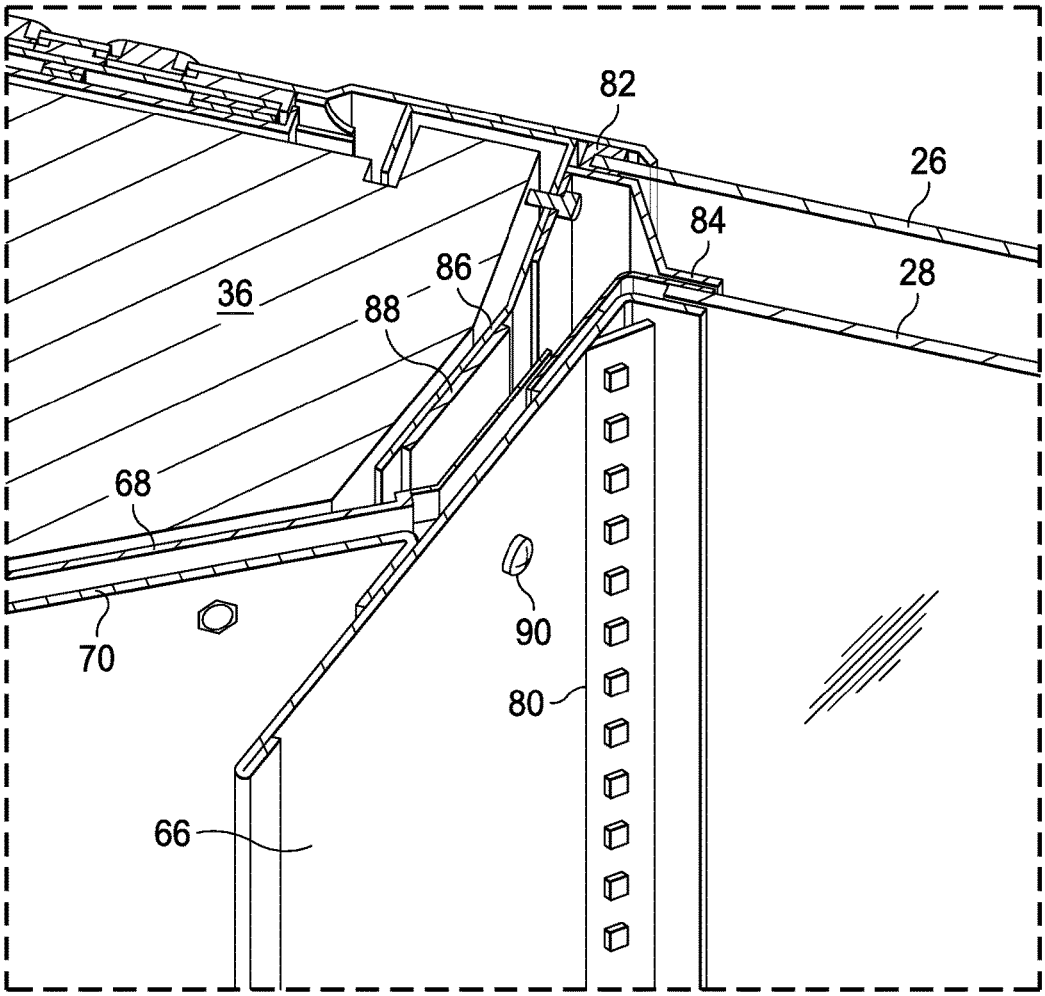
FIG. 13 is a detailed rear perspective view of Detail E shown in FIG. 9.

As further illustrated in FIG. 13, an additional support member 86 may extend vertically within the storage compartment 22. A first portion of the additional support member 86 may extend into the compartment behind the interface 16. A second portion of the additional support member 86 may extend parallel with and be bonded to the customer facing portion of the frame 18. A third portion of the additional support member 86 may extend from the customer facing portion of the frame 18 at a perpendicular angle. A forth portion of the additional support member 86 may angle towards the controller 36. The additional support member 86 may be formed around the edge of the controller 36.

Figure 11:
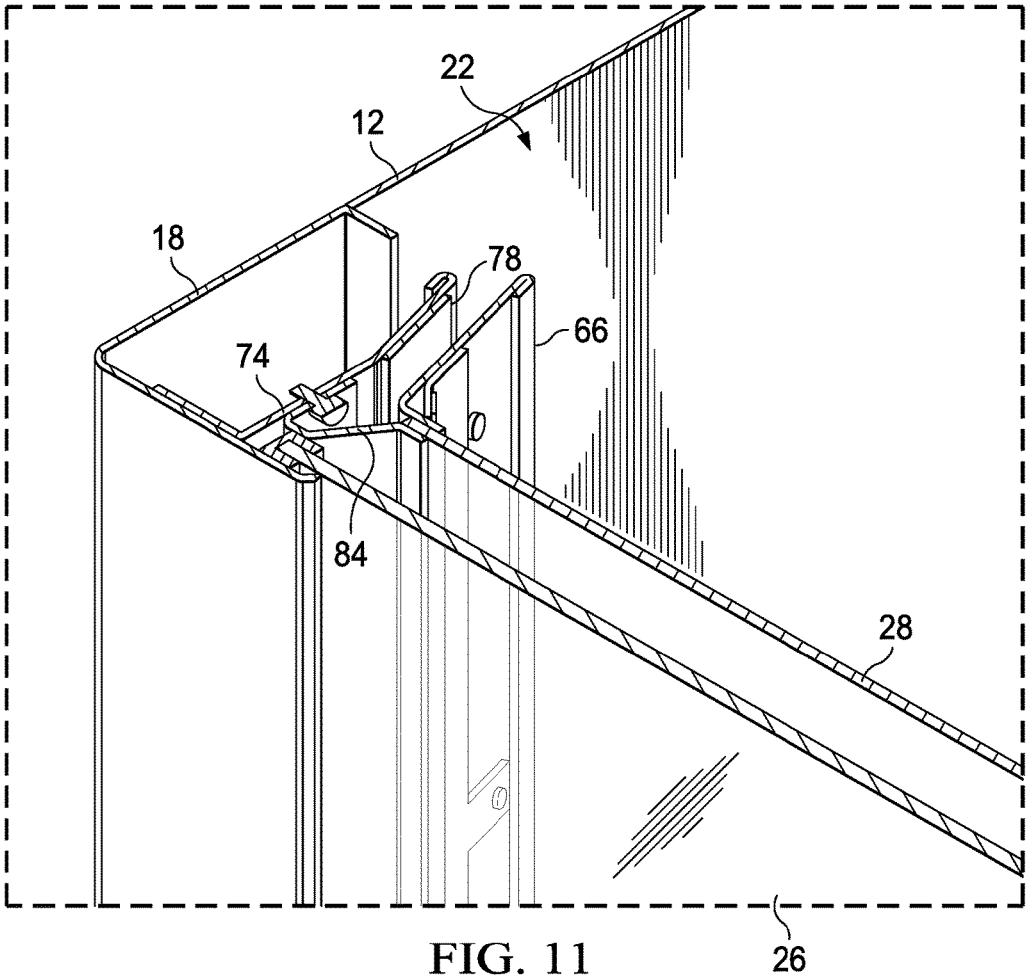
FIG. 11 is a detailed perspective view of Detail F shown in FIG. 9.

FIG. 11 Similarly, the other side of the assembly 10 may comprise another lighting panel 66 and side mask frame 84. A portion of the lighting panel 66 may extend in parallel with and be bonded to the electronic display 28. The remainder of the lighting panel 66 may extend at an obtuse angle from the electronic display 28 into the storage compartment 22.

Figure 12:
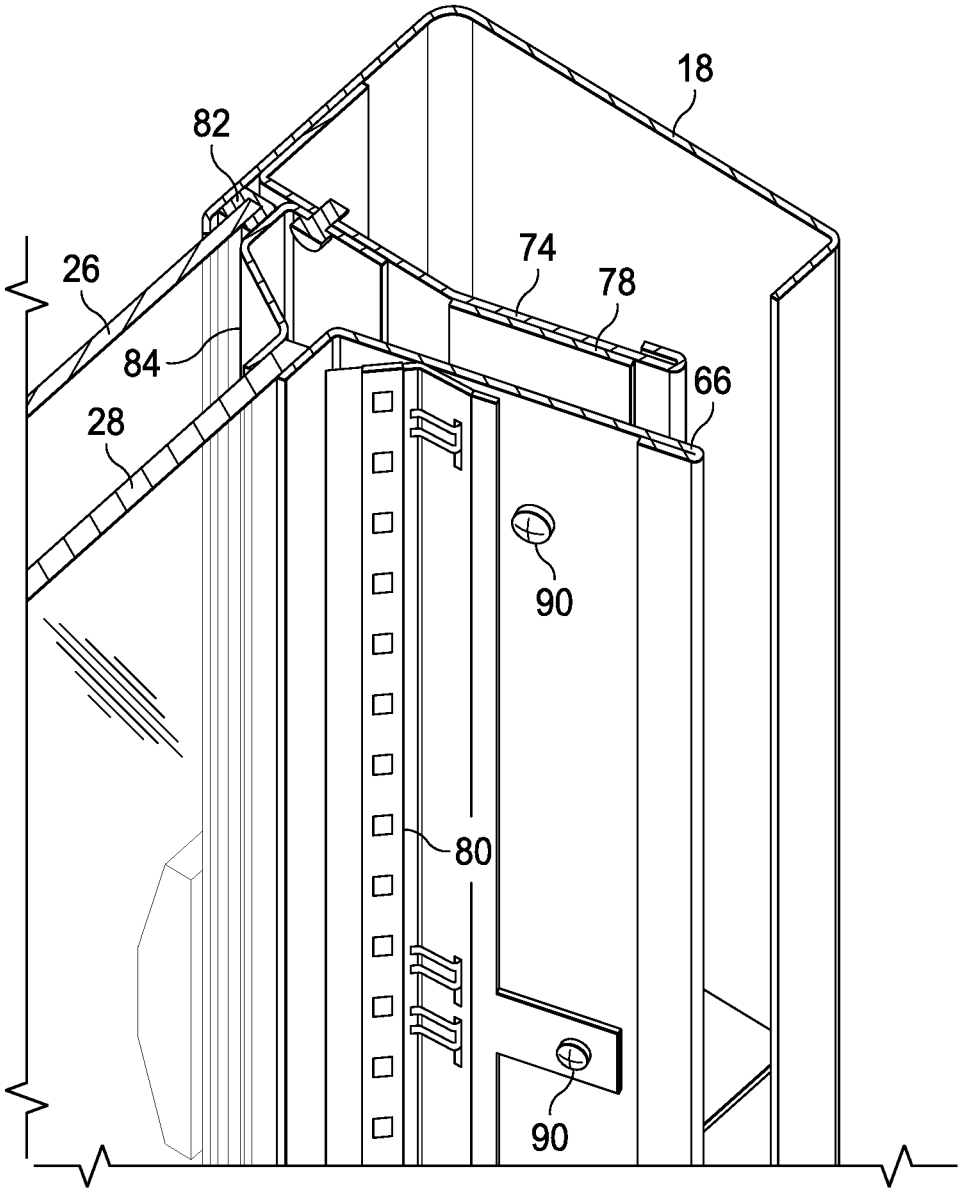
FIG. 12 is a detailed rear perspective view of Detail F shown in FIG. 9.

As further illustrated in FIG. 12, a support bracket 74 may extend vertically within the storage compartment 22. A first portion of the support bracket 74 may extend parallel with the customer facing portion of the frame 18 and be bonded thereto. A second portion of the support bracket 74 may extend outwardly from the customer facing portion of the frame 18 into the storage compartment 22. A third portion of the support bracket 74 may extend at an obtuse angle from the electronic display 28 such that it extends substantially in parallel with the lighting panel 66. A portion of the trailing edge of the support bracket 74 may fold over itself such that it forms a J-shape.

In exemplary embodiments of the present invention, a reinforcement member 78 may be attached to the support bracket 74. The reinforcement member 78 may be C-shaped such that each end of the C is bonded to the support bracket 74 and the mid-section of the C extends in parallel with, and spaced apart from, the support bracket 74.

FIG. 12 A rear view of FIG. 11 reveals a lighting strip 80. The lighting strip 80 may comprise a series of illumination devices mounted to a bracket. The lighting strip 80 may be mounted at an angle between the portion of the lighting panel 66 that extends in parallel with the electronic display 28 and the portion that extends at an angle therefrom. The illumination devices may include, but are not limited to, light emitting diodes (LEDs). The illumination devices may be used to illuminate the products stored within the storage compartment 22. The lighting strips 80 may be in communication with the controller 36 and the controller 36 may control the illumination of the lighting strip 80.

The lighting strip 80 may be bonded to the lighting panel 66 by high temperature pressure sensitive adhesives (PSAs), though any bonding means is contemplated. Alternatively, or in addition, the lighting strip 80 may be secured to the lighting panel by the use of fasteners 90. Likewise, the lighting panel 66 may be attached to the support bracket 74, or the reinforcement member 78 where utilized, by fasteners 90. The fasteners 90 may be screws, nails, or the like.

A side groove 82 similar to groove 32 may receive the side edge of the front panel 26. The side groove 82 may be bonded to the frame 18 and the side mask frames 84. The groove 82 may also be bonded to the support bracket 74.

FIG. 13 A rear view of FIG. 10 likewise reveals the lighting strip 80 mounted at an angle between the portion of the lighting panel 66 that extends in parallel with the electronic display 28 and the portion that extends at an angle therefrom. The support member 86 may similarly comprise a reinforcement member 88. The reinforcement member 88 may be similar to the reinforcement member 78 and likewise may be located on the angled portion of the support bracket 86.

Figure 14:
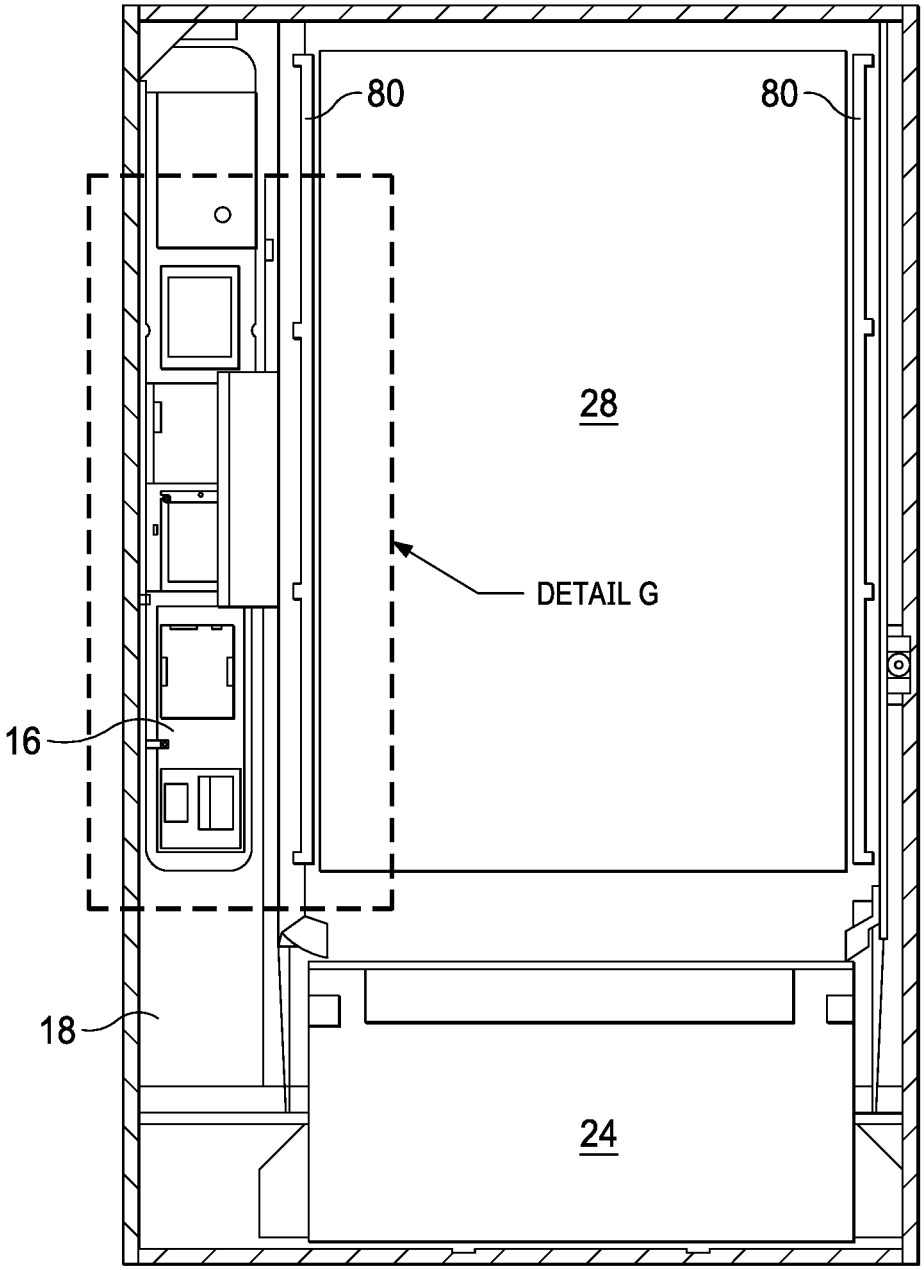
FIG. 14 is a rear view of the door assembly also indicating Detail G.

FIG. 14 The pair of lighting strips 80 are located on either side of the electronic display 28 and may be angled such that the pair of lighting strips 80 illuminate the various products stored inside the storage compartment 22.

Figure 15:
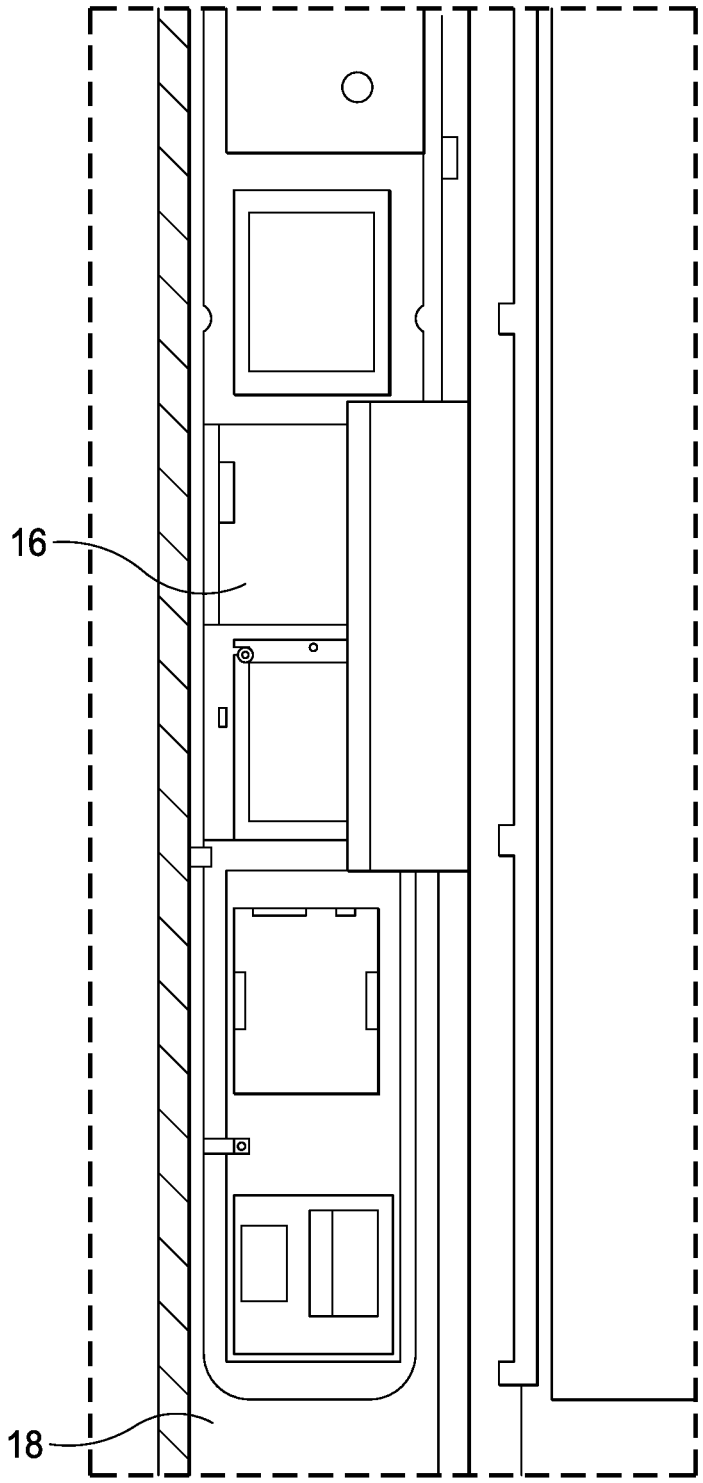
FIG. 15 is a detailed view of Detail G shown in FIG. 14.

FIG. 15 The interface 16 may be comprised of various electronic components which may be assembled into the frame 18. The various electronic components may include, but are not limited to, printed circuit boards, illumination devices, displays, interfaces, LEDs, currency acceptors, change dispensers, receipt printers, and the like.

Having shown and described a preferred embodiment of the invention, those skilled in the art will realize that many variations and modifications may be made to affect the described invention and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

What is claimed is:

1. A vending machine for showcasing and selling retails goods to a user while displaying electronic images comprising:

a storage compartment configured to hold the retail goods;

a pair of lighting strips located in said storage compartment for illuminating the retail goods;

a cover glass;

a transparent organic light emitting diode (OLED) display having a front and a rear surface and located behind and substantially parallel to the cover glass, wherein said transparent OLED display is configured to display the electronic images while also permitting the user to view the retail goods;

a door frame assembly housing the cover glass and the transparent OLED display and configured to permit access to the storage compartment;

a controller in communication with the transparent OLED display and configured to control the electronic images displayed on the transparent OLED display;

a plurality of masking brackets, each secured to the front surface of said transparent OLED display and an inner surface of said door fame assembly, wherein said masking brackets are configured to obstruct the view beyond said masking brackets;

a pair of display brackets, each having a first and a second surface wherein said first surface is secured to the rear surface of the transparent OLED display and said second surface is secured to an inner surface of the door frame assembly; and a plurality of cover glass brackets, each substantially surrounding an outer edge of said cover glass and sandwiched between said door frame assembly and said masking brackets, wherein said cover glass brackets are substantially C shaped and are placed around the top, bottom, and side edges of the cover glass.

2. The vending machine of claim 1, wherein:

said masking brackets comprise a first, second, and middle portion, wherein:

said first portion is substantially parallel with the front surface of said transparent OLED display, said second portion is substantially parallel with the inner surface of said door frame assembly, and said middle portion extends between said first and second portions.

3. The vending machine of claim 2, wherein:

said first portion is secured to said transparent OLED display by way of a gasket.

4. The vending machine of claim 2, wherein:

said masking brackets are substantially Z or S shaped.

5. The vending machine of claim 1, wherein:

said first surface of each of said display brackets is secured to an upper or lower portion of said transparent OLED display.

6. The vending machine of claim 5, wherein:

the transparent OLED display is secured to said first surface of said display brackets by a double-sided adhesive tape.

7. The vending machine of claim 1, wherein:

said cover glass comprises two transparent panels laminated together.

8. The vending machine of claim 1, wherein:

said controller comprises:

a processor, an electronic storage device, and a wireless transmitter/receiver.

9. The vending machine of claim 1, further comprising:

a pair of lighting panels connected to the rear surface of the transparent OLED display and extending at an obtuse angle into said storage compartment, wherein said lighting strips are mounted to said lighting panels.

10. A vending machine for showcasing and selling retails goods while displaying electronic images comprising:

a storage compartment configured to showcase the retail goods;

a pair of lighting strips configured to illuminate the retail goods;

a transparent cover;

a transparent electronic display positioned behind, spaced apart from, and substantially parallel to said transparent cover, wherein the space between the transparent electronic display and the transparent cover defines a gap;

an access panel assembly housing the transparent cover and the transparent electronic display;

a controller in communication with the transparent electronic display and configured to control the electronic images displayed thereon;

a plurality of brackets configured to secure said transparent electronic display and said transparent cover to said door frame assembly and cover the gap;

a pair of display brackets each secured to the transparent electronic display and an inner surface of the access panel assembly;

a pair of lighting panels connected to said transparent electronic display and extending at an obtuse angle into said storage compartment, wherein said lighting strips are mounted to said lighting panels; and a pair of support brackets, each located behind one of said lighting panels and extending at an obtuse angle from the inner surface of said access panel assembly into the storage compartment.

11. The vending machine of claim 10, further comprising:

a plurality of cover brackets configured to secure said transparent cover to said access panel assembly.

12. The vending machine of claim 11, wherein:

the cover brackets are sandwiched between said plurality of brackets and said access panel assembly.

13. The vending machine of claim 10, wherein:

the display brackets are substantially L shaped and comprise a first and a second surface, wherein said first surface is adhered to an upper or lower portion of the transparent electronic display and the second surface is adhered to an inner surface of the access panel assembly.

14. The vending machine of claim 10, wherein:

said plurality of brackets comprises a first, second, and third portion, wherein:

said first portion is secured to a front surface of the transparent electronic display, said third portion extends substantially parallel to said first portion and is secured to an inner surface of said access panel assembly, and said second portion extends between the first portion and the second portion.

15. The vending machine of claim 10, wherein:

the width of the transparent cover is greater than the width of the transparent electronic display.

16. The vending machine of claim 15, wherein:

the height of the transparent electronic display is greater than the height of the transparent cover.

* * * * *